United States Patent [19]

Dragstrem

[11] Patent Number: 4,555,820

[45] Date of Patent: Dec. 3, 1985

[54] DRAIN PIPE SYSTEM

[76] Inventor: John A. Dragstrem, 1845 Hawaii Dr. E., Jacksonville, Fla. 32216

[21] Appl. No.: 575,014

[22] Filed: Jan. 30, 1984

[51] Int. Cl.[4] ..... E03D 11/00

[52] U.S. Cl. ..... 4/256; 4/191; 137/247.19; 137/605

[58] Field of Search ..... 4/255, 256, 257; 134/167 C, 168 C, 166 C, 169 C; 137/247.17, 247.19, 247.21, 247.23, 247.41, 247.51, 322, 605, 527.8

[56] References Cited

U.S. PATENT DOCUMENTS

| | | | |
|---|---|---|---|
| 201,758 | 3/1878 | Downey | 137/247.19 |
| 215,928 | 5/1879 | Hutchinson . | |
| 441,751 | 12/1890 | Crowner | 137/247.17 |
| 730,463 | 6/1903 | Keyt | 137/247.19 |
| 734,682 | 7/1903 | Doyle . | |
| 764,900 | 7/1904 | Schalt | 134/168 C |
| 766,764 | 8/1904 | Keyt | 137/247.41 X |
| 831,722 | 9/1906 | Holmes . | |
| 1,000,719 | 8/1911 | Cram | 137/527.8 X |
| 1,067,583 | 7/1913 | Brague | 137/322 |
| 1,239,319 | 9/1917 | Vampa . | |
| 1,885,977 | 11/1932 | Denison | 4/256 X |
| 1,903,735 | 4/1933 | Krieger . | |
| 1,938,064 | 12/1933 | Carmine | 182/22 |
| 2,617,491 | 11/1952 | Ross | 137/247.19 |
| 2,627,610 | 2/1953 | Hirshstein | 4/255 |
| 3,897,601 | 8/1975 | Wusterfeld | 4/255 |
| 3,936,892 | 2/1976 | Miller | 4/255 |
| 4,406,301 | 9/1983 | Cerrato | 137/322 X |

*Primary Examiner*—Charles E. Phillips
*Attorney, Agent, or Firm*—Arthur G. Yeager

[57] ABSTRACT

A system for clearing clogged drain pipes comprising a drain pipe section either straight or P-trap, having a closeable side inlet adjacent the upstream end of the pipe, means to connect the side inlet to a source of pressurized water, an anti-backflow device removably insertable in said side inlet, and a hinged flap valve inside the drain pipe hanging downwardly in its open position over the interior juncture of the side inlet and the drain pipe and movable upwardly to its closed position to prevent any upward flow through the drain pipe. This system is useful in all drains to remove obstructions in the drain pipe.

16 Claims, 11 Drawing Figures

DRAIN PIPE SYSTEM

BACKGROUND OF THE INVENTION

Almost every homeowner has experienced the problems resulting from a clogged drain pipe under a sink. The clogging usually is caused by fats, soaps, and food particles which collect in the drain pipe and eventually completely close the pipe to gravity flow from the sink. Various methods and devices have been employed with varying success to remove the clogging material and restore the drainage flow. Mechanical devices, such as a drain auger (commonly called a plumber's snake), or a rubber plunger, are normally used to unplug the drain. Powerful solvents containing alkali are frequently poured into the drain to dissolve the clogging material. More recent systems involve the use of pressurized hot or cold water (from the tap at the sink) through a side inlet in the U-tube section of the drain pipe. These systems, of course, require some means of applying the force of pressurized water to the upstream side of the clogging material without permitting any of the pressurized water to flow upwards into the sink. Some prior art systems have employed a valve built into the drainage line which can be turned to provide free flow of water from the sink or to close off the flow to or from the sink and at the same time open flow from a side inlet through which pressurized water can be introduced to force the clogging material to move downwardly in the drain pipe to a sewer line. Typical of such systems are those disclosed in U.S. Pat. No. 215,928 to Hutchinson; U.S. Pat. No. 734,682 to Doyle; and U.S. Pat. No. 1,938,064 to Carmine. These systems, however, are deficient in that they introduce into the drain line obstructions which may cause clogging to occur more easily than would be the case if the drain line had no unclogging devices at all.

It is an object of this invention to provide an improved system for opening clogged drain lines from sinks. It is another object of this invention to provide an improved system that will prevent any possibility of contaminating backflow from the drain pipe into the purified water supply. Still other objects will appear from the more detailed description which follows.

BRIEF DESCRIPTION OF THE INVENTION

This invention relates to a gravity flow drain pipe system which is subject to clogging. The system of this invention provides an improved means to remove the obstruction. It comprises a side inlet to a pipe upstream from the zone of sedimentation, means to connect the side inlet to a source of pressurized water, an anti-backflow device insertable in said side inlet permitting the inflow of pressurized water and preventing any backflow from said drain pipe out said side inlet, a hinged flap valve in said drain pipe upstream from said side inlet which prevents backflow into the sink when the flap is in the closed position and permits gravity flow through the drain pipe when the flap is in the open position.

In a preferred embodiment of this invention the flap valve includes an annular seat which is removably insertable into the upstream end of the drain pipe and a saddle-shaped flap pivotably attached to the seat such that the flap hangs downwardly by the force of gravity and rests its outer convex surface against the inner cylindrical surface of the pipe covering a substantial portion of the opening leading from the side inlet pipe; the flap being closeable against the seat to prevent any flow of pressurized water upwardly into the sink.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
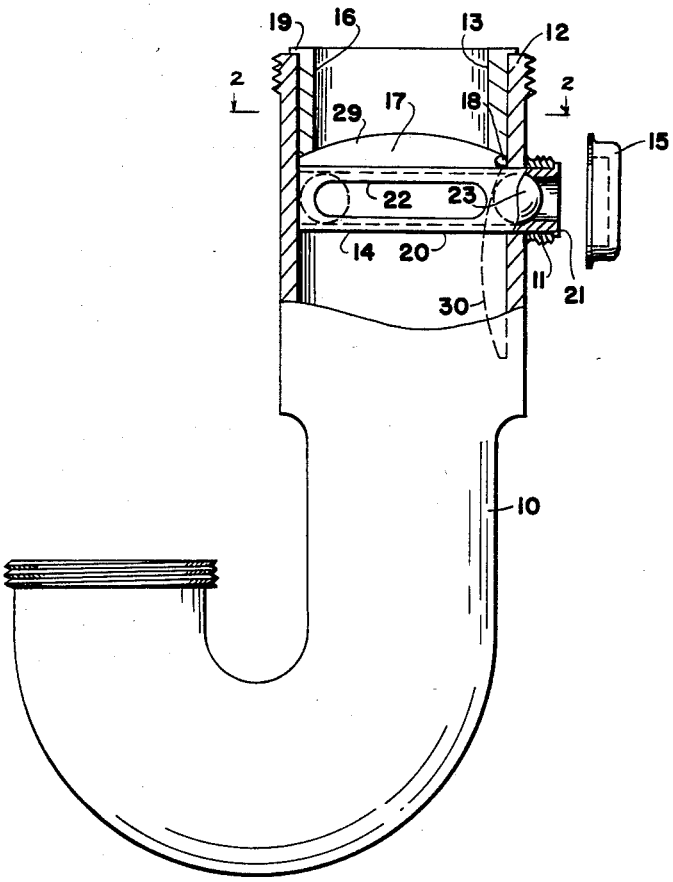
FIG. 1 is a front elevational view partially in cross-section of a U-shaped drain pipe with the component parts of the invention in place.
Figure 2:
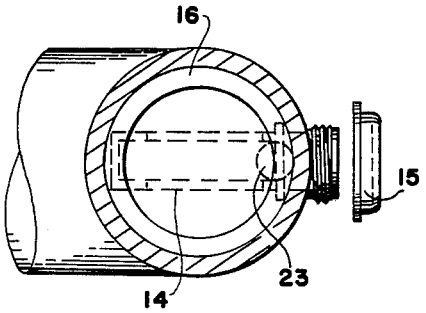
FIG. 2 is a cross sectional view at 2—2 of FIG. 1.

The overall assembly of the various components of this invention in a U-shaped or J-shaped drain trap is illustrated in FIGS. 1 and 2 of the attached drawings. Drain trap 10 has an upstream end 12 which is threaded for attachment by way of a pipe union to a downflow pipe leading from a sink or other vessel. A side inlet pipe entrance 11 is located adjacent the upstream end 12 of the drain trap 10. Preferably side inlet 11 is threaded to receive pipe cap 15 which is capable of providing a water tight closure to prevent any outflow of drainage. Inside of drain trap 10 at its upstream end 12 is flap valve combination 13 which consists of an annular seat 16 fitting snugly against the interior cylindrical surface of drain trap 10, a pivotable flap 17, may be in a closed position as shown at 29 or in an open position as shown at 30. Preferably, flap valve combination is mounted so that the force of gravity maintains flap 17 in the open position 30 which rests its convex surface against the inside cylindrical surface of drain trap 10 and substantially covers the opening leading to side inlet pipe 11.

Anti-backflow device 14 preferably is a cylindrical tubular article with freely moving ball inside that moves with the flow of water or a check valve, insertable into side inlet pipe 11 across the interior of drain trap 10. This device prevents contaminative drainage from flowing outwardly from the inside of drain trap 10 through side inlet pipe 11, which normally is connected to a source of sanitary pressurized water. The anti-backflow means preferably includes a check valve or ball valve (shown in its closed position 34). When pressurized water flows inwardly through side inlet pipe 11, the ball will roll away to its open position 33 or the check valve will pivot or otherwise move to the open position.

Figure 4:
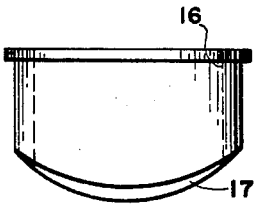
FIG. 4 is a side elevational view of the flap valve of this invention.
Figure 3:
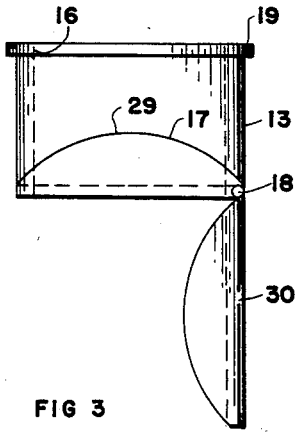
FIG. 3 is a front elevational view of the flap valve of this invention.
Figure 5:
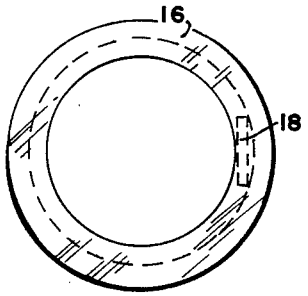
FIG. 5 is a top plan view of the flap valve of this invention.
Figure 9:
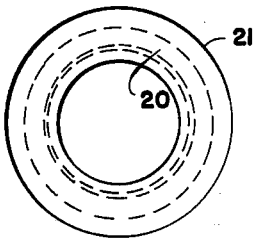
FIG. 9 is a top plan view of the second embodiment of the anti-backflow device of this invention.
Figure 8:
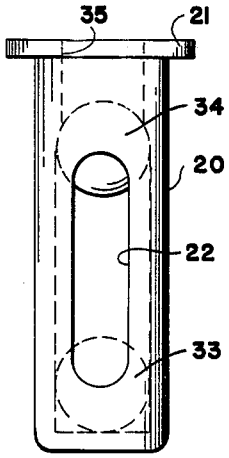
FIG. 8 is a front elevational view of a second embodiment of the anti-backflow device of this invention.

In FIGS. 3, 4 and 5 there is shown a preferred construction of flap valve combination 13. An annular valve seat 16 is a thin tubular section designed to fit snugly into the upstream end of drain trap 10 (FIG. 1), or straight pipe section (FIGS. 8 and 9). A pivotable flap 17 is connected to seat 16 by a hinge 18 or any other pivotable alternative. For example, seat 16 and flap 17 may be connected by a flexible resilient strip of material that may be the same as the material of flap 17, e.g., synthetic rubber or elastomeric plastic. Flap 17 is saddle shaped with its convex surface a cylindrical section that will rest against the interior cylindrical wall of drain trap 10. A convenient method of positioning flap valve combination 13 in drain trap 10 is to provide an outwardly directed flange 19 on the upstream end of seat 16 which will rest over the upstream end of the threads on pipe trap 10 and will be clamped in place when drain trap 10 is joined by a pipe union to the downflow pipe of a sink.

The anti-backflow device 14 of this invention is shown in two alternative embodiments in FIGS. 6–9. The device includes in its preferred form, a cylindrical tubular body 20 having one or more large passageways 22 through its sidewalls and an outwardly directed flange 21 at its inlet end 33. Flange 21 permits device 14 to be inserted into side inlet pipe 11 and to be held in place when a threaded coupling is tightened over the threads on inlet opening 11. The purpose of this device is to prevent drainage from siphoning or flowing into a sanitary water source which is connected to inlet pipe 11.

Figure 7:
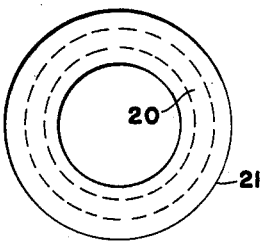
FIG. 7 is a top plan view of the first embodiment of the anti-backflow device of this invention.
Figure 6:
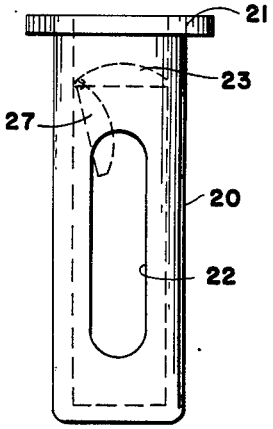
FIG. 6 is a front elevational view of a first embodiment of the anti-backflow device of this invention.

One embodiment of this device is shown in FIGS. 6 and 7 as a swinging or pivotable check valve having a closed position 23 or an open position 27 with the valve gate pivoting about hinge 31. Preferably this device is inserted into side inlet pipe 11 such that the force of gravity urges the valve gate to hang downward in closed position 23 and with hinge 31 on the upper side of the valve gate. The force of pressurized water entering inlet pipe 11 will cause the valve gate to swing to open position 27.

A second embodiment of this anti-backflow device is shown in FIGS. 8 and 9 as a ball valve. A freely movable ball is enclosed inside tubular body 20 to move between the extremes of open position 33 and closed position 34. Inlet end 35 of tubular body 20 must be somewhat smaller in diameter than the inside diameter of body 20 so as to form a seat for the ball valve to rest against in preventing any backflow from drain trap 10 outwardly through side inlet pipe 11. The force of pressurized water entering through pipe 11 will move the ball to open position 33 automatically, and any attempt at backflow of water from drain trap 10 outwardly of pipe 11 will automatically move the ball to closed position 34 to stop the backflow. Other equivalent anti-backflow means are feasible for use in this invention, particularly those employing other designs of check valves or ball valves.

Figure 10:
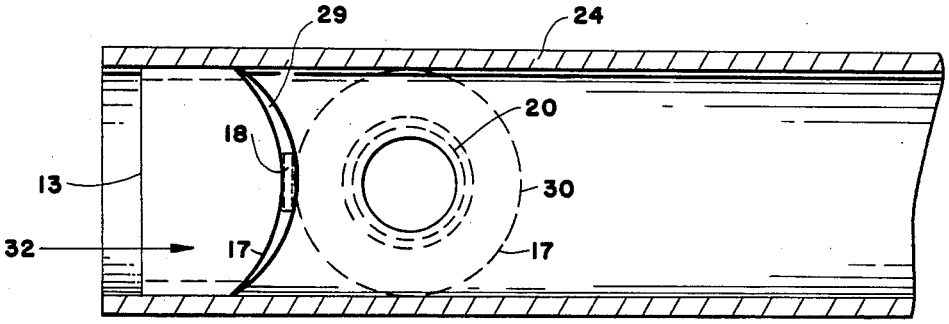
FIG. 10 is a top plan view of the system of this invention in a straight pipe.
Figure 11:
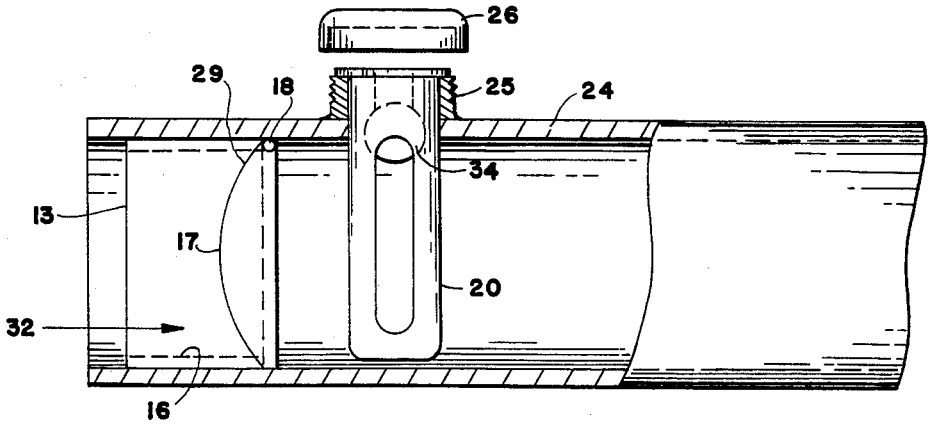
FIG. 11 is a front elevational view of the system of this invention in a straight pipe.

In FIGS. 10 and 11 there is shown how this invention can be applied to a straight pipe in a drainage system. Pipe 24, preferably a straight section of plastic pipe, is fitted with a side inlet pipe 11 having outside threads and a removeable cap 26. Anti-backflow device 14 is employed in side inlet pipe 11 exactly the same as described above with respect to U-shaped or J-shaped drain traps. Flap valve combination 13 is inserted into pipe 24 upstream of side inlet pipe 11 and may be cemented in place or held thereby means of a small flange similar to that shown in FIGS. 1, 3 and 4. Flap valve functions in exactly the same manner as described above with respect to FIG. 1. If straight pipe 24 is positioned vertically, flap 17 will hang downwardly by gravity in the open position until anti-backflow device 14 is inserted into side inlet pipe 11. If pipe 24 is positioned horizontally, gravity will cause flap 17 to hang in either the open or closed position depending on the orientation of valve combination 13 in the pipe, but because of the free pivotal action of hinge 18, flap 17 will swing open to allow any drainage flow through the pipe in the direction of arrow 32, and will be closed when anti-backflow device 14 is inserted into pipe 24.

Flap valve combination 13 may be made of any material suitable for the purposes of the valve action. If drain trap 10 or straight pipe 24 is steel, valve 13 may be made of steel or rubber or plastic. If drain trap 10 or straight pipe 24 is plastic, valve 13 may also be plastic. In order to provide good valve action, valve 13 may be made of a suitable plastic or elastomeric material. Anti-backflow device is preferably made of plastic, such as polyethylene, although metal devices are also usually suitable.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. In a drain pipe system having an upstream end and a downstream end the improvement which comprises a closeable side inlet pipe adjacent the upstream end thereof and having means to connect to a water source a flap valve having a flap pivotably connected adjacent said inlet pipe, said flap valve being positioned upstream of said side inlet pipe such that said flap hangs downwardly by the force of gravity with its surface normally convering a substantial portion of said side inlet opening, and a removably insertable anti-backflow device adapted to be inserted into said side inlet pipe and to close automatically to prevent any flow drainage from the drain pipe system outwardly through said side inlet pipe, said anti-backflow device being shaped such that when inserted through said side inlet pipe it will force said flap to be closed thereby closing the drain pipe system and when removed it will permit said flap to be open against the inside of and to open the said drain pipe system.

2. The system of claim 1 wherein said anti-backflow device comprises a hollow tubular sleeve containing internally thereof a check valve positioned to let water flow from said side inlet into said drain pipe but not in the reverse direction.

3. The system of claim 2 wherein said check valve is a float ball or a hinged flap which opens by force of said pressurized water and closes upon any flow reverse to that of said pressurized water.

4. The system of claim 1 wherein said hinged flap valve comprises a rigid tubular seat insertable into said drain pipe with close tolerances, a saddle-shaped rigid flap hingedly connected to said seat such that when said valve is open the convex side of said flap rests with the inside contour of said drain pipe, and when said valve is closed the concave side of said flap rests against said seat.

5. The system of claim 4 wherein said tubular seat has an outwardly extending flange around its upstream edge to seat on the threaded upstream end of a drain pipe.

6. The system of claim 4 wherein said flap valve is oriented such that it is maintained in the open position by the force of gravity.

7. The system of claim 1 which includes a removeable cap adapted to close said side inlet.

8. The system of claim 1 wherein said pipe is a U-shaped drain pipe.

9. The system of claim 1 wherein said pipe is a section of straight run pipe.

10. The system of claim 1 wherein said anti-backflow device comprises a hollow tubular sleeve containing internally thereof, a freely movable ball adapted to move to and from a position where the ball closes off any possible backflow from said drain pipe outwardly through said side inlet pipe.

11. In a drain pipe system having a U-shaped pipe trap having an upstream and a downstream end, the improvement which comprises a closeable side inlet pipe having an opening in communication with said trap adjacent the upstream end thereof and having means to connect to a water source, an annular seat at the upstream end of said trap and a saddle-shaped flap pivotably connected adjacent said seat, said flap valve having a convex surface normally facing said inlet pipe and being positioned upstream of said side inlet pipe such that said flap hanges downwardly by the force of gravity with said convex surface resting against the inside of said drain pipe and covering a substantial portion of said side inlet pipe opening, and a removably insertable anti-backflow device adapted to be inserted into said side inlet pipe and to close automatically to prevent any flow drainage from said pipe trap outwardly through said side inlet pipe, said anti-backflow device being shaped such that when inserted through said side inlet pipe it will force said flap to be closed against said seat and when removed it will permit said flap to be open against the inside of said drain pipe.

12. The system of claim 11 wherein said anti-backflow device includes a check valve through which pressurized water may flow only in the direction into said side inlet into said pipe trap.

13. The system of claim 11 which includes pipe threads on the side inlet and a threaded closure to mate with said pipe threads when said device is removed from said side inlet.

14. The system of claim 11 wherein said annular valve seat includes an outwardly directed flange on its upstream end to engage the upstream end of said pipe trap.

15. The system of claim 11 wherein said anti-backflow device is a cylindrical article having an outwardly directed flange at the rear end thereof to removably engage the other end of said side inlet pipe.

16. The system of claim 11 wherein said anti-backflow device is a hollow tubular article with an outwardly directed flange at the rear end thereof to removably engage the outer end of said inlet pipe and a freely movable ball in the interior of the hollow tubular section adapted to move into and away from a valve seat to prevent any backflow of liquid from said drain pipe outwardly through said side inlet pipe.

* * * * *